US005131515A

United States Patent [19]

Scamardo

[11] Patent Number: 5,131,515

[45] Date of Patent: Jul. 21, 1992

[54] SAFETY APPARATUS CLOSURE LOCK CONTROLLING ACCESS TO ROTATIONAL MEMBER

[75] Inventor: Dennis M. Scamardo, Hanford, Calif.

[73] Assignee: Westlake Farms, Inc., Stratford, Calif.

[21] Appl. No.: 687,941

[22] Filed: Apr. 19, 1991

[51] Int. Cl.[5] ..... D01G 31/00

[52] U.S. Cl. ..... 192/135; 19/0.2; 19/203

[58] Field of Search ..... 192/135; 19/0.2, 0.22, 19/203

[56] References Cited

U.S. PATENT DOCUMENTS

| | | | |
|---|---|---|---|
| 633,930 | 9/1899 | Ward et al. | 192/135 |
| 639,685 | 12/1899 | O'Connell | 192/135 |
| 1,837,244 | 12/1931 | Watson . | |
| 2,174,018 | 9/1939 | Schaum . | |
| 2,373,411 | 4/1945 | Pierrepont . | |
| 2,518,548 | 8/1950 | Howland | 192/135 X |
| 2,683,516 | 7/1954 | Pierrepont | 192/135 |
| 2,844,239 | 7/1958 | Batson et al. . | |
| 3,049,208 | 8/1962 | Parkes | 192/135 |
| 3,817,363 | 6/1974 | Wigington, Jr. . | |
| 3,915,273 | 10/1975 | Loschengruber . | |
| 4,364,151 | 12/1982 | Beneke et al. | 19/0.2 |
| 4,416,035 | 11/1983 | Schwartz . | |
| 4,611,703 | 9/1986 | Bliss | 192/135 |

*Primary Examiner*—Rodney H. Bonck
*Attorney, Agent, or Firm*—Worrel & Worrel

[57] ABSTRACT

A safety apparatus for controlling access to a work object having an active mode and a passive mode, the apparatus having a lock assembly for obstructing access, in a first condition, and alternatively permitting access, in a second condition, to the work object; a detector for detecting when the work object is in the active mode and in the passive mode; and a control system operably interconnecting the lock assembly and the detector operable when the work object is in the active mode, as detected by the detector, to maintain the lock assembly in the first condition and when the work object is in the passive mode, as detected by the detector, to maintain the lock assembly in the second condition.

9 Claims, 3 Drawing Sheets

SAFETY APPARATUS CLOSURE LOCK CONTROLLING ACCESS TO ROTATIONAL MEMBER

BACKGROUND OF THE INVENTION

1. Field of the Invention

The present invention relates to a safety apparatus and, more particularly, to such a safety apparatus which interoperates with conventional machines, such as cotton lint cleaners and the like, to proscribe a secure zone about the operative components thereof so as to protect personnel from injury.

2. Description of the Prior Art

Industry is dependent upon the use of mechanical devices, and particularly heavy machinery, in performing the required processes. Typically a multiplicity of manufacturing steps must be performed in sequence at a rapid pace in order to ensure that a sufficient volume is produced consistent with the price range required of the marketplace. In order to maintain such volume while minimizing overhead expense, the industrial age has seen heavy reliance on machinery to perform the required steps. While the use of such machinery has produced increasingly dramatic increases in productivity, the hazards associated with such productivity are ever present.

For example, in the commercial production of cotton fiber, various machines are required to process the fiber prior to it being compressed into bales for sale to other industries which use the cotton fiber for the manufacture of other products. One of the machines employed in such ginning operations, and usually in banks or batteries of such machines, is the lint cotton cleaning machine. Such machines operate to remove leaf particles, motes, grass and bark left in the cotton fiber after processing by seed cotton cleaners and extractors. In most ginning operations, batteries of such lint cleaning machines are employed at two or more stages in the ginning operation.

Lint cleaning machines are characterized by the use of a condenser screen drum to form the cotton fiber into a batt which is removed from the condenser screen drum by two doffing rollers and fed through one or more sets of compression rollers. Thereafter, the batt is passed between a very closely fitted feed roller and feed plate or bar and fed onto a saw cylinder. Each set of compression rollers rotates slightly faster than the preceding series of rollers which causes the batt to be thinned to some degree. The feed roller and plate grip the batt so that a combing action takes place as the saw teeth seize the cotton fiber. The tolerances involved in the spacing of the elements of the lint cleaning machine are very small. For example, the feed plate clears the saw cylinder by only about one-sixteenth of an inch. A doffing brush assembly removes lint from the saw cylinder and passes it from the lint cleaning machine for further processing.

Since such lint cleaning machines operate at a very high velocity in substantially continuous operation during the season, their operation must be monitored so as immediately to be able to detect breakdown and to remove blockage that may develop very rapidly. Still another condition which must be monitored is that of fire caused by the cotton fiber being heated during passage through the lint cleaning machine.

The rapid development of clogging or burning cotton fiber in the area of the compression rollers is the triggering event for injury to personnel. Such accidents occur when personnel attempt to gain access to the interior of the lint cleaning machine for the removal of excess or burning cotton fiber before the saw cylinder and/or feed rollers have come to a complete stop. As a direct consequence of the high inertial load of the saw cylinder, the time required for the saw cylinder to come to a complete stop is approximately two minutes in conventional machines. The aggravation of the condition during that two minute period as witnessed by such personnel constitutes an overbearing motivation for personnel to attempt to alleviate the problem even before such movement of the saw cylinder and feed rollers is terminated.

Whereas, lint cleaning machines are not the most frequent cause of accidents in the ginning industry, the accidents resulting therefrom account for the most debilitating and costly injuries. These injuries most commonly occur from removal of the access grates of the machines by personnel prior to the machine coming to rest and the insertion of fingers between the compression rollers. Since the compression rollers draw the fingers into the machine, the most gruesome injuries can take place. In order to prevent such injuries, various prior art methods have been employed to prevent removal of the access grates. However, once the operative parts of the lint cleaning machine come to a stop, the access grates must rapidly be removed to correct the particular problem. Prior art methods have not permitted sufficiently rapid removal of the access grates and therefore are frequently not used even though available. They have thus not proved satisfactory.

Therefore, it has long been known that it would be desirable to have a safety apparatus which can be employed on machinery to prevent access to the interior thereof during an operative mode, but which permits immediate access to the interior once the machine has reached an inoperative mode; which has particular utility in use on such heavy equipment as lint cleaning machines employed in cotton ginning operations; and which operates inexpensively and completely dependably to preclude injury to personnel as a result of gaining access to the interior of such machinery prior to reaching the inoperative mode.

SUMMARY OF THE INVENTION

Therefore, it is an object of the present invention to provide an improved safety apparatus.

Another object is to provide such a safety apparatus which interoperates with conventional machinery to prevent personnel from gaining access to the interior of such machinery for maintenance prior to the machinery fully reaching a passive or inoperative mode.

Another object is to provide such a safety apparatus which prevents entry to the interior thereof prior to an inoperative mode, but which permits immediate access to the interior upon such inoperative mode having been reached.

Another object is to provide such a safety apparatus which has particular utility in use on lint cleaning machines employed in the ginning industry preventing personnel from reaching into the interior portions of the machinery prior to the moving portions thereof coming to a complete halt.

Another object is to provide such a safety apparatus which requires that all operative conditions consistent with full operation to have been reached prior to being able to reactivate operation of the lint cleaning machine.

Another object is to provide such a safety apparatus which not only precludes access by personnel to the interior portions of the machine prior to that machine reaching an inoperative mode, but also interoperates with the machine to reduce the interval of time required for the machine to reach the inoperative mode after being switched off.

Another object is to provide such a safety apparatus which is fully compatible with conventional lint cleaning machinery without requiring substantial retrofitting of component parts and systems thereon.

Another object is to provide such a safety apparatus which is capable of sensing precisely when all motion within the machine ceases and at substantially the same instant permits immediate access to the interior of such machinery for maintenance by personnel.

Another object is to provide such a safety apparatus which substantially precludes injury to personnel working around such machinery.

Further objects and advantages are to provide improved elements and arrangements thereof in an apparatus for the purpose described which is dependable, economical, durable and fully effective in accomplishing its intended purpose.

These and other objects and advantages are achieved in the safety apparatus of the present invention in operation with a work object having an active mode and a passive mode, the apparatus having control means for obstructing access, in a first condition, and alternatively permitting access in a second condition, to said work objects; means for detecting when the work object is in said active mode and in said passive mode; and a control system operably interconnecting the control means and the detecting means operable when the work object is in said active mode, as detected by the detecting means, to maintain the control means in the first condition and when the work object is in the said passive mode, as detected by the detecting means, to maintain the control means in the second condition.

DESCRIPTION OF THE PREFERRED EMBODIMENT

Figure 1:
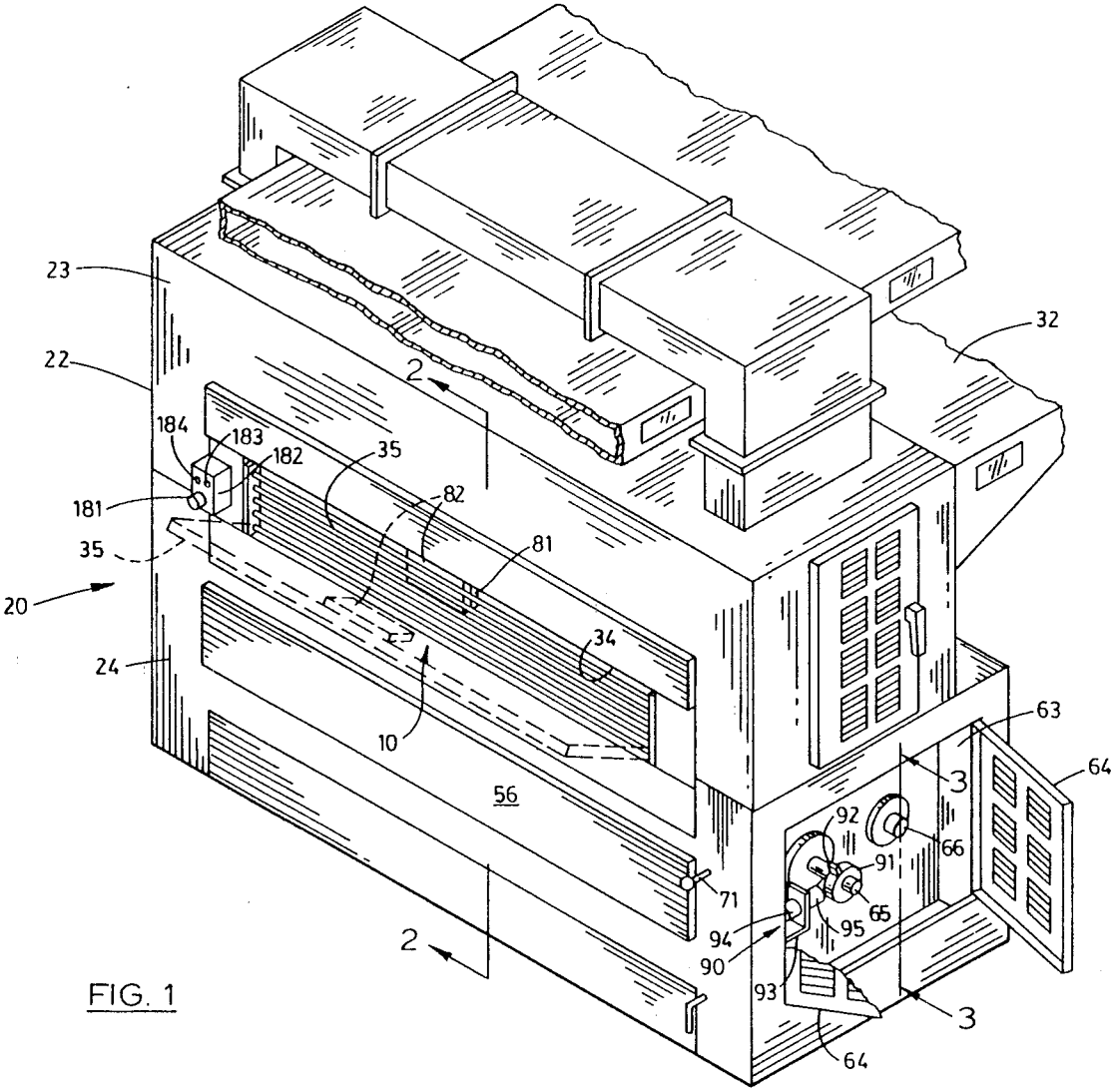
FIG. 1 is a fragmentary perspective view of a lint cotton cleaning machine mounting the safety apparatus of the present invention.
Figure 4:
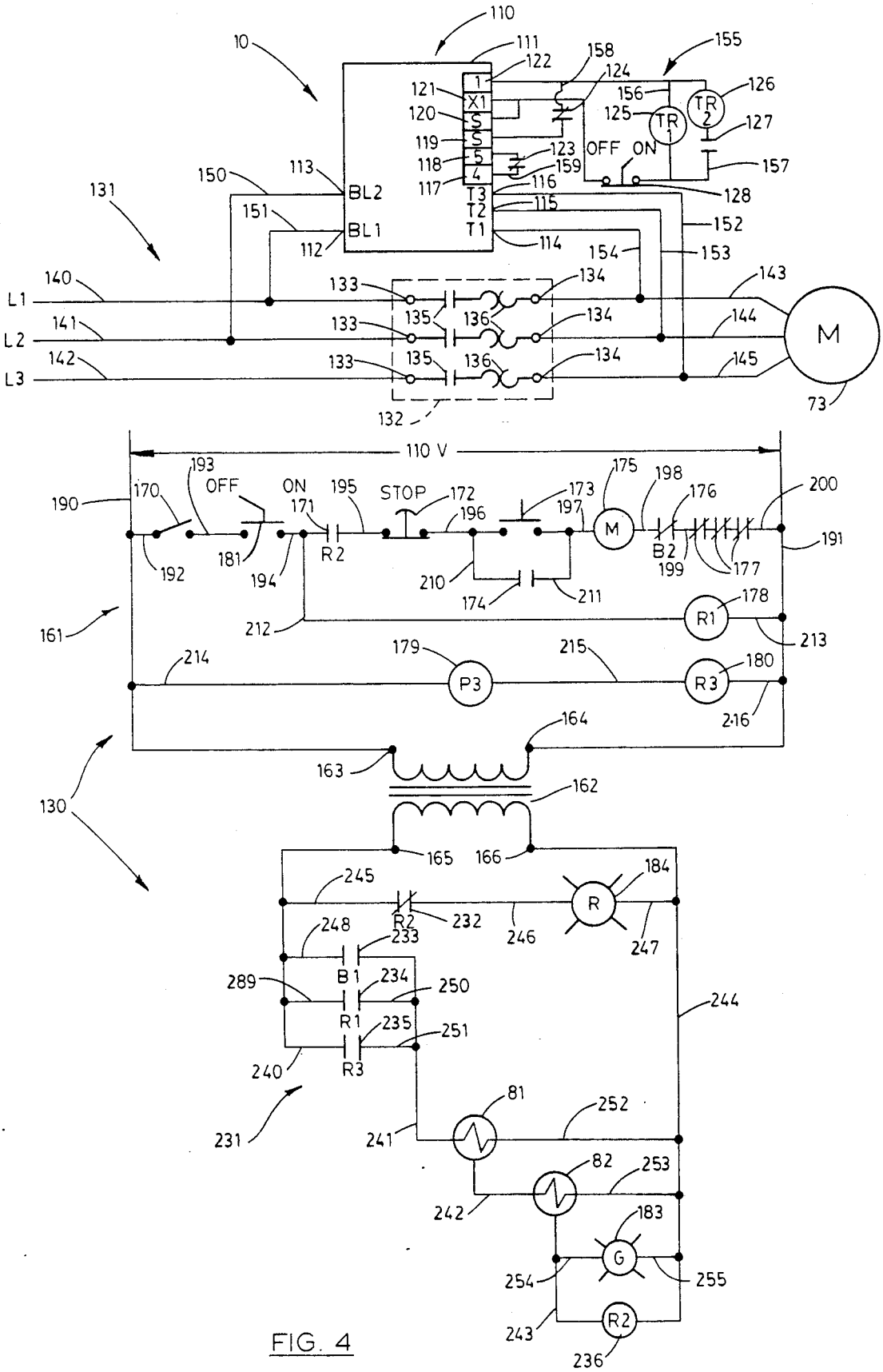
FIG. 4 is a schematic diagram of the electrical control system of the safety apparatus of the present invention.

The safety apparatus of the present invention is generally indicated by the numeral 10 in FIGS. 1 and 4 where it is shown in a typical operative environment. It will, however, be understood that the safety apparatus of the present invention is adaptable for use in a host of operative environments and on virtually any type of machinery wherein it is desired to prevent access to the internal working parts of the machinery prior to the machinery reaching a passive or fully inoperative mode.

Referring more particularly to FIG. 1, a conventional cotton lint cleaning machine is generally indicated by the numeral 20. The cotton lint cleaning machine is conventional except, as herein noted, in that it is fitted with the safety apparatus 10 of the present invention. The cotton lint cleaning machine is mounted on a supporting surface 21 and has a main housing 22 consisting of an upper housing 23 and a lower housing 24.

Figure 2:
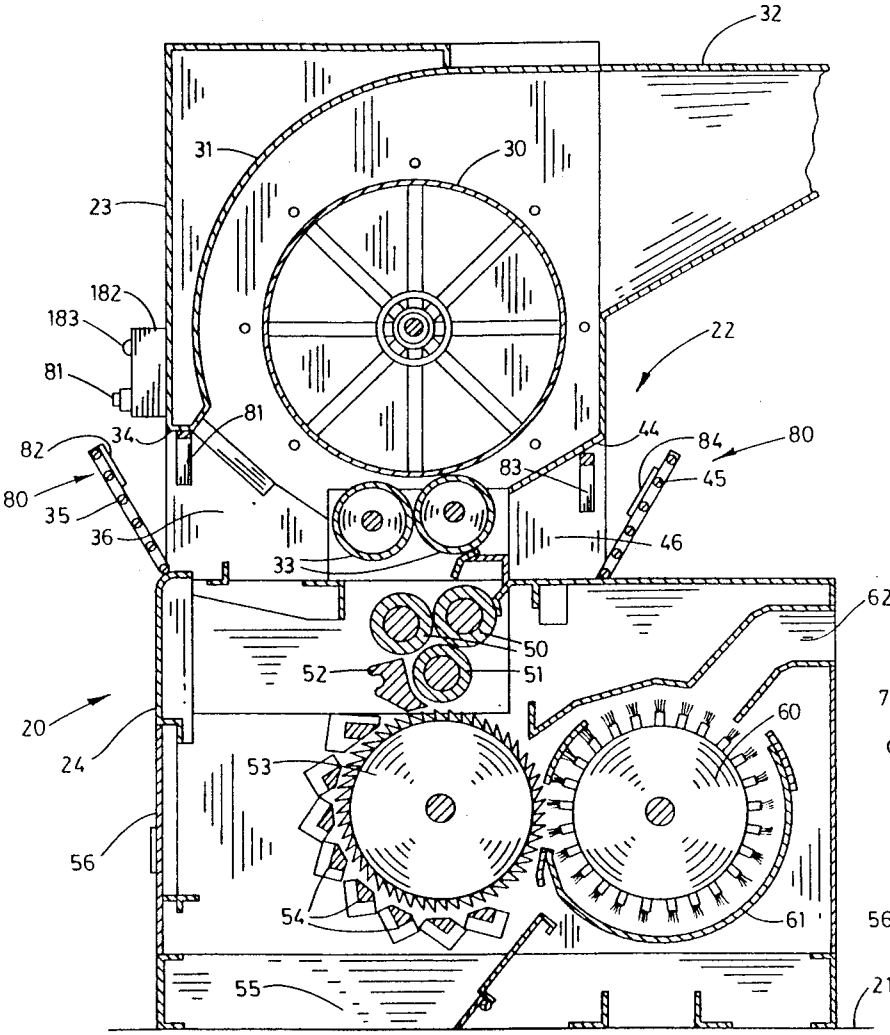
FIG. 2 is a somewhat enlarged transverse, vertical section taken on line 2—2 in FIG. 1.

Referring more particularly to FIG. 2, the cotton lint cleaning machine 20 has a condenser screen drum assembly 30 mounted for rotational movement in a drum housing 31 which is fed with cotton lint or fiber, not shown, by a supply conduit 32. A pair of doffing roller assemblies 33 are mounted for rotational movement beneath the condenser screen drum assembly at the bottom of the drum housing for rotational movement about axes of rotation substantially parallel to that of the condenser screen drum assembly.

The upper housing 23 has a front access opening 34 dimensioned to receive a front access gate or closure 35 in fitted relation within the front access opening to prevent access to a front chamber 36. The upper housing 23 has a rear access opening 44 dimensioned to receive a rear access grate or closure 45. The rear access grate is adapted to be received in the rear access opening so as to prevent access to a rear chamber 46.

A pair of compression roller assemblies 50 are mounted in the upper part of the lower housing 24 for rotational movement about axes of rotation substantially parallel to the axes of the doffing roller assemblies 33 and condenser screen drum assembly 30. The front access grate 35 and rear access grate 45 are disposed in closed positions to prevent access to the structure heretofore described while the lint cleaning machine is in operation. However, in conventional lint cleaning machines, the access grates are easily removed or are simply left loose or out of position by personnel for convenience in gaining access to the interior thereof. It is precisely this characteristic of the operation of such machines that the safety apparatus of the present invention, in the illustrative embodiment herein described, is designed to prevent.

A feed roller assembly 51 is mounted for rotational movement in the lower housing 24 immediately beneath the compression roller assemblies 50. A feed plate or bar 52 is mounted adjacent to the feed roller assembly. A saw cylinder assembly 53 is mounted for rotational movement in the lower housing beneath the feed roller assembly 51 and is bounded on one side and the lower portion thereof by saw cylinder bars 54. The lower housing has a trash discharge passage 55 and a saw cylinder access door 56.

A doffing brush assembly 60 is mounted for rotational movement about an axis of rotation substantially parallel to the axes of rotation heretofore described. The doffing brush assembly is housed within a doffing brush housing 61 leading to a fiber discharge passage 62. The lower housing has a side compartment 63 shown best in FIG. 3 to which access is gained by opening the access doors 64 shown in FIG. 1, but not FIG. 3 for illustrative convenience.

Figure 3:
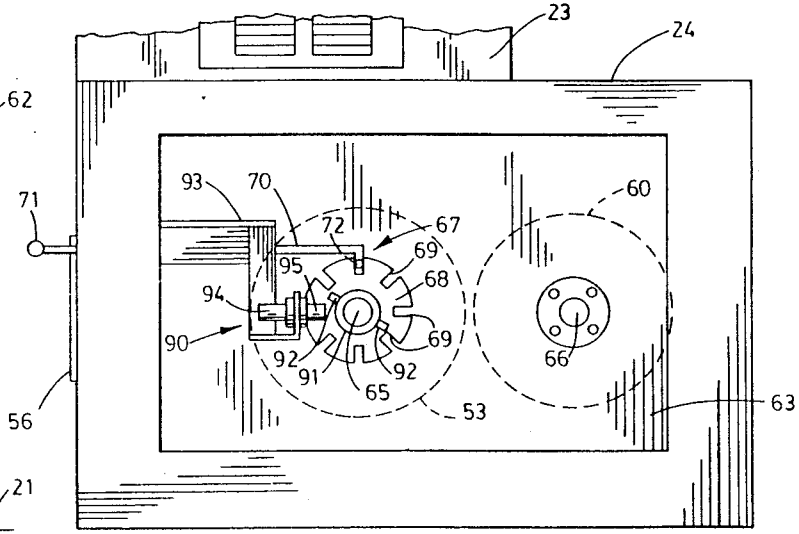
FIG. 3 is a somewhat enlarged fragmentary plan view of the apparatus of FIG. 1 taken on line 3—3 in FIG. 1 with the access doors removed for illustrative convenience.

The saw cylinder assembly 53 includes a shaft 65 on which it rotates and which extends into the side compartment 63. The doffing brush assembly 60 includes a doffing brush assembly shaft 66 which also extends into the side compartment substantially parallel to the saw cylinder shaft 65. As shown in FIG. 3, a saw cylinder shaft lock assembly 67 is mounted on the lower housing and extends into the side compartment 63. The saw cylinder shaft lock assembly includes a locking wheel 68 mounted on the saw cylinder shaft 65 and having radially extending notches 69. A locking arm 70 extends into the side compartment from externally of the lower housing and has a handle 71 on the end thereof which is external of the lower housing. A locking pin 72 is mounted on the opposite end of the locking arm and adapted for selective engagement in one of the notches 69 of the locking wheel permitting the saw cylinder shaft 65 to be locked in position to prevent movement thereof, such as during maintenance of the lint cleaning machine.

The saw cylinder shaft lock assembly is used in conventional lint cleaning machines to prevent access to the saw cylinder assembly during operation of the lint cleaning machine as mandated by law. This is achieved by the saw cylinder shaft lock assembly in that the locking arm 70 engages the saw cylinder access door so as to prevent it being opened until the saw cylinder shaft comes to a complete stop and the locking pin 72 is engaged in one of the notches 69. Thereafter, personnel can open the saw cylinder access door 56 to gain access to the saw cylinder assembly. Since this structure is entirely conventional, no further description is provided herein. No such safety system conventionally exists for the front and rear access grates 35 and 45, respectively, nor is there any legal mandate that such systems be provided therefore.

The lint cleaning machine 20 is driven by a three phase main drive motor 73 shown diagrammatically in FIG. 4.

The structure heretofore described is entirely conventional. The structure hereinafter described constitutes the novel safety apparatus 10 of the present invention. The safety apparatus has a magnetic lock assembly 80 best shown in FIG. 2. The magnetic lock assembly includes a front electromagnet 81 mounted in the front access opening 34 on the upper housing 23.

A front ferrous metal strike plate 82 is mounted by any suitable means on the front access closure or grate 35 in position to be in facing engagement with the electromagnet 81 when the front access grate is in the closed position filling and thereby obstructing the front access opening 34. A rear electromagnet 83 is mounted in the rear access opening 44 on the upper housing 23. A rear ferrous metal strike plate 84 is mounted on the rear access grate 45 in position to be disposed in facing engagement with the rear electromagnet when the rear access grate is in the closed position filling, and thereby obstructing, the rear access opening. In the preferred embodiment of the invention, the electromagnets are the "Magnalock 62" manufactured by Securitron of Torrance, Calif. However, any suitable electromagnets can be employed.

The safety apparatus 10 also has a motion detector assembly 90, shown best in FIG. 3. The motion detector assembly includes a collar 91 mounted on the saw cylinder shaft 65 within the side compartment 63 of the lower housing 24. The collar mounts a pair of target members 92 on opposite sides thereof and extending outwardly therefrom one hundred and eighty degrees (180°) from each other about the collar. A mounting bracket 93 is mounted on the lower housing 24 within the side compartment. A motion detector 94 is mounted on the mounting bracket as shown in FIG. 3 in alignment with the collar 91 and therefore with the path of travel described by the target members in moving with the saw cylinder shaft 65. The motion detector has a sensing end portion 95 which extends to a position such that the target members pass in juxtaposition to the sensing end portion so as to be detectable thereby. In the preferred embodiment of the invention, the motion detector is a "Veeder-Root Motion Dector Model 77853" manufactured by Veeder-Root Digital Products of Hartford, Conn. However, any suitable motion detector can be employed.

The safety apparatus 10 further includes an augmentation means or dynamic brake assembly 110, shown in the schematic diagram in FIG. 4. The dynamic brake assembly includes a dynamic brake 111. The dynamic brake, being itself of conventional design, is not shown herein beyond the schematic representation shown in FIG. 4. In the preferred embodiment, the dynamic brake is a "Baldor/Lectron Dynamic Brake Model #B73CP manufactured by Baldor/Lectron of Torrance, Calif. However, any suitable dynamic brake can be employed.

The dynamic brake 111 has a BL1 electrical connection 112, a BL2 electrical connection 113, a T1 electrical connection 114, a T2 electrical connection 115 and a T3 electrical connection 116. Further, the dynamic brake has a number 4 electrical connection 117, a number 5 electrical connection 118, an S electrical connection 119, an S electrical connection 120, an X1 electrical connection 121 and a number 1 electrical connection 122.

The safety apparatus 10 includes electrical contacts 123, electrical contacts 124, a TR1 timer 125, a TR2 timer 126, electrical contacts 127 and an on-off switch 128.

The safety apparatus 10 has an electrical system generally indicated by the numeral 130 in FIG. 4. The electrical system includes a primary electrical supply system 131 which, in part, includes a portion of the conventional electrical system of the lint cleaning machine 20. This includes a motor starter 132 of conventional design and having three input electrical connections 133 and three output electrical connections 134. The motor starter has three electrical contacts 135 and three overload units 136. An electrical conductor 140 extends from a source of electrical energy, not shown, and is attached to a first of the three input electrical connectors 133. An electrical conductor 141 extends from the source of electrical energy and is connected to a second of the three input electrical connections 133. An electrical conductor 142 extends from the source of electrical energy and is connected to a third of the three input electrical connections 133. An electrical conductor 143 operatively interconnects a first of the three output electrical connections 134 and the main drive motor 73. An electrical conductor 144 operatively interconnects a second of the three output electrical connections 134 and the main drive motor 73. An electrical conductor 145 operatively interconnects a third of the three output electrical connections 134 and the main drive motor 73. Turning then to the portions of the electrical system 131 constituting part of the safety apparatus 10 of the present invention, an electrical conductor 150 interconnects electrical conductor 141 and the BL2 electrical connection 113. An electrical conductor 151 interconnects electrical conductor 140 and the BL1 electrical connection 112. An electrical conductor 152 interconnects the T3 electrical connection 116 and the electrical conductor 145. An electrical conductor 153 interconnects the T2 electrical connection 115 and electrical conductor 144. An electrical conductor 154 interconnects the T1 electrical connection 114 and the electrical conductor 143.

The primary electrical supply system 131 includes a timer electrical system 155 shown in FIG. 4 and constituting part of the safety apparatus 10 of the present invention. For illustrative convenience and as shown in FIG. 4, the timer electrical system includes a first timer circuit 156 linking the X1 electrical connection 121 and the S electrical connection 120, both of the dynamic brake 111, with the on-off switch 128, TR1 timer 125 and number 1 electrical connection 122. A second timer circuit 157 interconnects the first timer circuit 156 on opposite sides of the TR1 timer 125 through the TR2 timer 126 and electrical contracts 127. A second electrical contact circuit 159 interconnects the number 4 electrical connection 117 and number 5 electrical connection 118, both of the dynamic brake, through the electrical contacts 123. A first electrical contact circuit 158 interconnects the S electrical connection 119 of the dynamic brake through the electrical contacts 124 with the first timer circuit 156 between the TR1 timer 125 and the number 1 electrical connection 122 of the dynamic brake.

The electrical system 130 includes an electrical control system 161, shown in FIG. 4. The electrical control system 161 includes a step down transformer 162 operable to convert the electrical current of the electrical control system from one hundred and ten (110) volts alternating current (A.C.) to twelve (12) volts direct current (D.C.). The transformer has a positive input contact 163, a negative input contact 164, a positive output contact 165 and a negative output contact 166.

The electrical control system 161 has a switch 170 which, in actuality, is mounted in the motor starter 132. The electrical control system has an R2 electrical contact 171, a stop switch 172, a momentary contact start switch 173 and electrical contacts 174. The electrical control system has a motor starter solenoid 175 and B2 electrical contacts 176. The electrical control system 161 has three overload unit electrical contacts 177, R1 electrical relay 178, a P3 motion detector connection 179 and an R3 electrical relay 180. In the preferred embodiment, the switches 172 and 173 are actually physically located at a main console, not shown, spaced some distance from the lint cleaning machine 20. The motor starter solenoid 175 is actually physically located in motor starter 132.

The electrical control system also includes a control switch 181 which is actually physically located in a front control switch housing 182 displaying a green light 183 and a red light 184. The on-off switch 128 is actually physically located in the control switch housing and is cooperable with the control switch 181.

The electrical control system 161 further includes an electrical conductor 190 extending from a source, not shown, of electrical energy of one hundred and ten (110) volts alternating current (A.C.) to the positive input contact 163 of the transformer 162. An electrical conductor 191 extends from the source of electrical energy of one hundred and ten (110) volts alternating current (A.C.) to the negative input contact 164 of the transformer. An electrical conductor 192 interconnects electrical conductor 190 and the switch 170. An electrical conductor 193 interconnects the switch 170 and the control switch 181 of the front control switch housing 182. Electrical conductor 194 interconnects the control switch 181 and the R2 electrical contacts 171. An electrical conductor 195 interconnects the R2 electrical contacts and the stop switch 172. An electrical conductor 196 interconnects the stop switch 172 and the start switch 173. Electrical conductor 197 interconnects the start switch 173 and the motor starter solenoid 175. An electrical conductor 198 interconnects the motor starter solenoid 175 and the B2 electrical contacts 176. An electrical conductor 199 interconnects the B2 electrical contacts 176 and the three overload unit electrical contacts 177. An electrical conductor 200 interconnects the three overload unit electrical contacts 177 and electrical conductor 191.

Electrical conductor 210 interconnects the electrical conductor 196 and the electrical contacts 174. An electrical conductor 211 interconnects the electrical contacts 174 and electrical conductor 197. Electrical conductor 212 interconnects electrical conductor 194 and the R1 electrical relay 178. Electrical conductor 213 interconnects the R1 electrical relay 178 and electrical conductor 191. Electrical conductor 214 interconnects electrical conductor 190 and the P3 motion detector connection 179. Electrical conductor 215 interconnects the P3 motion detector connection 179 and the R3 electrical relay 180. Electrical conductor 216 interconnects the R3 electrical relay 180 and electrical conductor 191.

The electrical system 130 of the safety apparatus 10 includes an electrical control system 231 shown in the schematic diagram of FIG. 4. The electrical control system 231 includes R2 electrical contacts 232, B1 electrical contacts 233, R1 electrical contacts 234, R3 electrical contacts 235 and an R2 electrical relay 236, all of which are shown in FIG. 4.

The electrical control system 231 includes an electrical conductor 240 connected to the positive output contact 165 and is connected at its opposite end to the R3 electrical contacts 235. An electrical conductor 241 interconnects the B1 electrical contacts 233 and the front electromagnet 81. An electrical conductor 242 interconnects the front electromagnet 81 and the rear electromagnet 83. An electrical conductor 243 interconnects the rear electromagnet 83 and the R2 electrical relay 236. An electrical conductor 244 interconnects the R2 electrical relay 236 and the negative output contact 166 of the transformer 162. Electrical conductor 245 interconnects the electrical conductor 240 and the R2 electrical contacts 232. An electrical conductor 246 interconnects the R2 electrical contacts 232 and the red light 184. Electrical conductor 247 interconnects the red light 184 and electrical conductor 244. Electrical conductor 248 interconnects electrical conductor 240 and the B1 electrical contacts 233. Electrical conductor 249 interconnects electrical conductor 240 and the R1 electrical contacts 234. Electrical conductor 250 interconnects the R1 electrical contacts 234 and electrical conductor 241. Electrical conductor 251 interconnects the R3 electrical contacts 235 and electrical conductor 241. Electrical conductor 252 interconnects the front electromagnet 81 and electrical conductor 244. Electrical conductor 253 interconnects the rear electromagnet 83 and electrical conductor 244. Electrical conductor 254 interconnects electrical conductor 243 and the green light 183. Electrical conductor 255 interconnects the green light 183 and electrical conductor 244.

OPERATION

The operation of the described embodiment of the subject invention is believed to be clearly apparent and is briefly summarized at this point. As previously noted, the cotton lint cleaning machine 20 is of conventional design except for the addition of the safety apparatus 10 heretofore described. Accordingly, the conventional operation of the cotton lint cleaning machine will not be described herein.

However, in order for the lint cleaning machine 20 to be operable where fitted with the safety apparatus 10 as described, certain conditions must be met. The front metal strike plate 82 and the rear metal strike plate 84 must be disposed in full facing engagement with their respective front electromagnet 81 and rear electromagnet 83 to complete the electrical path to the R2 electrical relay 236 closing the R2 electrical contacts 171. This prevents the lint cleaning machine from starting with either of the access doors 35 or 45 in an opened condition. As can be visualized in FIG. 2, this can only be achieved by positioning the front access grate 35 and rear access grate 45 in the closed conditions, such as shown in FIG. 1, with respect to the front access grate. Secondly, the control switch 181 must be placed in the "on" position to complete the electrical control system 161 therethrough. When these two conditions have been met, the electrical control system 231 is completed. This is indicated by the green light 183 of the front control switch housing 182 on the front of the upper housing 23. If either of the two conditions is not met, the lint cleaning machine cannot be operated.

Actual initiation of operation of the lint cleaning machine 20, after the foregoing conditions have been met, is achieved at the main console, not shown, remote from the lint cleaning machine. At the main console, the start switch 173 is closed to complete the circuit therethrough to the motor starter solenoid 175 which operates the motor starter 132 to initiate operation of the main drive motor 73 by supplying electrical energy from the source, not shown, through the primary electrical supply system 131. The lint cleaning machine thereby operates continuously in the normal fashion without the safety apparatus in any respect interfering with such operation.

During normal operation, and for long periods of time, the lint cleaning machine 20 may be permitted to operate continuously and may be stopped at the console using switch 172 during periods of nonuse and restarted using start switch 173 without the safety apparatus 10 of the present invention interfering with such normal and conventional operation of the lint cleaning machine.

However, at times when a malfunction develops, such as clogging of the cotton fiber at the compression roller assemblies 50 or fire, operation of the safety apparatus 10 ensures that injury to personnel in such circumstances is avoided. For example, if personnel monitoring operation of the lint cleaning machine 20 witness through the front or rear access grates 35 or 45, respectively, such an emergency developing, the person immediately moves the control switch 181 adjacent to the front access grate to the "off" position. Such movement of the control switch brakes the electrical control system 161 through the control switch 181 and thus terminates the flow of electrical energy through the primary electrical supply system 131 to the main drive motor 73. Simultaneously through an electrical connection, not shown, the flow of cotton fiber to the lint cleaning machine from the gin stand is terminated. However, as previously described, the inertial load of the conventional rotational assemblies within the lint cleaning machine, and particularly of the saw cylinder assembly 53, are such that rotation of these assemblies continues for some period of time and conventionally up to two minutes after the conventional lint cleaning machine is switched off.

For the reasons previously noted, it is the objective of the safety apparatus 10 of the present invention to prevent removal of either the front access grate 35 or rear access grate 45 until all such motion has ceased. This is achieved in that the motion detector 94 through motion detector connection 179 continues to supply electrical energy through the electrical control system 161 to the R3 electrical relay 180 which maintains the R3 electrical contacts 235 in a closed condition. As a consequence, electrical energy continues to be supplied to the electromagnets 81 and 83 through the electrical control system 231 so that the electromagnets are both energized magnetically to hold their respective metal strike plates 82 and 84 so as to lock the front and rear access grates 35 and 45 in the closed conditions.

Moving of the control switch 181 to the "off" position also triggers operation of the dynamic brake assembly 110. The turning of the control switch 181 to the "off" position also moves the on-off switch 128 of the dynamic brake assembly to the "on" condition which initiates the brake sequence. The TR1 timer 125 of the dynamic brake assembly is activated briefly and then closes electrical contacts 127 to activate the TR2 timer 126. The operable effect of the TR1 timer 125 is to delay activation of the dynamic brake 111 for about five (5) seconds to permit fiber within the lint cleaning machine to pass through.

After the time has run, the dynamic brake 111 is activated. The dynamic brake then converts the alternate current (A.C.) voltage supplied thereto to direct current (D.C.) voltage. This is supplied to the main drive motor 73 along electrical conductors 153 and 154 to reverse the flow of electrical current through the rotor of the main drive motor 73, thus, resisting rotation of the stator of the main drive motor so as to bring it to a halt more quickly. Electrical conductor 152 determines when the motor has come to a stop and through the T3 electrical connection 116 terminates operation of the dynamic brake.

Since, of course, the rotor of the main drive motor 73 is linked, through drive belts, not shown, in direct driving relation to the condenser screen drum assembly 30, doffing roller assemblies 33, compression roller assemblies 50, feed roller assembly 51, saw cylinder assembly 53 and doffing brush assembly 60, the inertial load thereof in rotation is much more quickly overcome and those components are brought to a halt more quickly than would otherwise be the case. This period of time, which conventionally is approximately two minutes, with the use of the dynamic brake assembly 110 is approximately twenty seconds, which includes the five (5) second delay. While the reversal of the flow of electrical energy through the rotor to resist rotation of the stator of the main electric motor 73 produces heat in the main drive motor, this heat is quickly dissipated. Furthermore, since the safety apparatus 20 operates only in unusual or emergency circumstances to cause such heat to develop, no damage is done to the main drive motor.

When the motion detector 94 senses that there is no rotation of the saw cylinder shaft 65, R3 elecrical relay 180 causes the R3 electrical contacts 235 to open thus terminating the flow of electrical energy to the front and rear electromagnets 81 and 83 and green light 183 and the R2 electrical relay 236. Thus, the electromagnets are deenergized, the green light 183 goes out and the R2 electrical contacts 232 are closed to supply electrical energy through the electrical control system 231 to the red light 184 to indicate to personnel that there is no rotation of the components within the lint cleaning machine 20. This simultaneously permits the front and rear access grates 35 and 45, respectively, to be removed from their closed conditions to expose their respective front chamber 36 and rear chamber 46 so that the personnel can immediately gain access to the interior of the machine to deal with whatever problem has developed.

As a consequence, the safety apparatus 10 of the present invention permits the safe use of machines such as lint cleaning machines by permitting, in an emergency situation, an operator to terminate operation of the machine and deal with the emergency condition significantly more rapidly than is conventionally possible while, at the same time, ensuring that no injury is possible resulting from the machine not having come to a complete stop.

Restarting of the lint cleaning machine 20 is not possible until the conditions previously identified are met. The front and rear access grates 35 and 45 respectively must be returned to the closed conditions with the strike plates 82 and 84 again placed in facing engagement with their respective electromagnets 81 and 83. The control switch 181 of the front control switch housing 182 must be placed in the "on" position. Once both of these conditions are met, the green light 183 will be illuminated. This indicates that the lint cleaning machine 20 can be reactivated in the otherwise conventional fashion from the main console, not shown, after disengaging the saw cylinder shaft lock assembly 67 previously described.

Therefore, the safety apparatus of the present invention can be employed on machinery to prevent access to the interior thereof during an operative mode, but permits immediate access to the interior once the machine has reached an inoperative mode; has particular utility in use on such heavy equipment as lint cleaning machines employed in cotton ginning operations; and operates inexpensively and completely dependably to preclude injury to personnel as a result of gaining access to the interior of such machinery prior to reaching the inoperative mode.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. In a lint cotton cleaning machine having a housing enclosing an interior and having an access opening dimensioned for ingress to the interior of the housing; a closure adapted for movement to and from a closed condition obstructing said access opening so as to prevent access to the interior of the housing; a condenser screen drum assembly and a pair of doffing roller assemblies mounted in the interior of the housing in proximity to said access opening; a saw cylinder assembly mounted within the interior of the housing for rotational movement on a saw cylinder shaft about an axis of rotation; a drive system linking the condenser screen drum assembly, pair of doffing roller assemblies and saw cylinder shaft in driving relation thereto for rotation thereof including rotation of the saw cylinder shaft and saw cylinder assembly about said axis of rotation; and an operating system operably connected to the drive system and including a control switch mounted externally of the housing selectively operable to activate and alternatively to deactivate the operating system for corresponding activation and alternatively deactivation of the drive system, a safety apparatus comprising:

A. a motion detector assembly including a motion detector mounted adjacent to said saw cylinder shaft and a target member mounted on the saw cylinder shaft for rotation therewith substantially in alignment with the motion detector whereby the motion detector can detect rotation of the saw cylinder shaft and thereby rotation of the condenser screen drum assembly and pair of doffing roller assemblies, by detecting movement of the target member;

B. a magnetic lock assembly including an electromagnet mounted on the housing substantially within said access opening of the housing, a metal plate mounted on the closure in position for substantially facing engagement with the electromagnet when the closure is in said closed condition and means for selectively energizing the electromagnet magnetically to lock the metal plate in engagement with the electromagnet and thus retain the closure in said closed condition; and C. an electrical control system operatively interconnecting said operating system of the lint cotton cleaning machine, the motion detector assembly and the magnetic lock assembly operable, when said control switch is operated to activate the operating system, to activate said energizing means to energize the electromagnet to retain the closure in said closed condition and operable, when said control switch is operated to deactivate the operating system, to maintain activation of the energizing means to maintain energizing of the electromagnet to retain the closure in said closed condition until the motion detector no longer detects rotation of the saw cylinder shaft and then to deenergize said energizing means to deenergize the electromagnet to permit the closure to be moved from said closed condition.

2. The safety apparatus of claim 1 including

D. a brake assembly operatively interconnecting the control system of the safety apparatus and the operating system of the machine and operable in a braking mode of operation, when said control switch is operated to deactivate the operating system, to slow rotation of the saw cylinder shaft and thus the rotation of the target member thereon until said motion detector no longer detects motion of the target member and thereby rotation of the saw cylinder shaft.

3. The safety apparatus of claim 2 in which the operating system of the lint cotton cleaning machine has an electric motor, including a rotor and stator, operable to drive said condenser screen drum assembly, pair of doffing roller assemblies, saw cylinder assembly and saw cylinder shaft and the target member borne thereby and wherein said brake assembly of the safety apparatus is operable in said braking mode to reverse the flow of electrical energy through the stator to resist and thereby slow rotation of the rotor and thereby the condenser screen drum assembly, pair of doffing roller assemblies, saw cylinder assembly and saw cylinder shaft.

4. The safety apparatus of claim 1 in which the housing has two access openings and two closures individually adapted for movement to and from corresponding closed conditions individually obstructing their respective access openings and wherein said magnetic lock assembly includes two electromagnets individually mounted on the housing substantially within said access openings and two metal plates individually mounted on the closures in positions for individual substantially facing engagement with their respective electromagnets when the closures are in said closed conditions and said energizing means operates simultaneously to energize the electromagnets magnetically to lock the metal plates in engagement with their respective electromagnets and thus retain the closures in said closed conditions.

5. The safety apparatus of claim 4 wherein the control system of the safety apparatus is operably connected to the drive system and the operating system of the lint cotton cleaning machine in such a fashion that before the control switch can be operated to activate the operating system of the lint cotton cleaning machine, the two closures must be in their respective closed conditions with the two electromagnets energized magnetically to retain two closures in their respective closed conditions.

6. The safety apparatus of claim 1 in which the operating system of the lint cotton cleaning machine includes a control panel located at a position remote from said machine and wherein said control system of the safety apparatus includes a master switch having a normally open condition to which it reverts when the operating system of the lint cotton cleaning machine is deactivated and which must be moved to a closed condition before the control switch of the operating system can be operated to activate said operating system.

7. The safety apparatus of claim 1 wherein the control system of the safety apparatus is operably connected to the drive system and operating system of the lint cotton cleaning machine in such a fashion that before the control switch can be operated to activate the operating system of the lint cotton cleaning machine, the closure must be in said closed condition with the electromagnet energized magnetically to retain said closure in the closed condition.

8. The safety apparatus of claim 1 wherein the saw cylinder shaft has the greatest inertia of motion as individually compared with the condenser screen drum assembly and pair of doffing roller assemblies whereby when motion of said saw cylinder shaft is no longer detected by the motion detector assembly, said condenser screen drum assembly and pair of doffing roller assemblies are no longer moving.

9. A saftey apparatus for controlling access through an entrance opening of a machine, obstructed by a closure in a closed attitude, to a member mounted within the machine for rotational movement substantially about a longitudinal axis and having an operating system which is operable to be activated to place the machine in an active mode of operation, wherein said member rotates substantially about said longitudinal axis, and to place said machine in an inactive mode of operation, wherein rotational force is no longer applied by the operating system to rotate said member substantially about said longitudinal axis, the safety apparatus comprising a motion detector mounted adjacent to said member and operable to detect motion of a target member; a target member mounted for rotation with said member in a position detectable by said motion detector; an electromagnet; a metal plate; means mounting said electromagnet and metal plate operably to retain said closure in the closed attitude when the electromagnet is energized; and an electrical control system operatively interconnecting said operating system of the machine, the motion detector and the electromagnet operable to energize the electromagnet in said active mode of operation of the machine to retain said closure in the closed attitude and in said inactive mode of operation to maintain the electromagnet in an energized condition to retain the closure in said closed attitude until the motion detector detects that the target member is no longer in motion and thereby that said member is not rotating substantially about said longitudinal axis and thereafter deenergizes the electromagnet to permit the closure to be moved from the closed attitude.

* * * * *

UNITED STATES PATENT AND TRADEMARK OFFICE

CERTIFICATE OF CORRECTION

PATENT NO. : 5,131,515

DATED : July 21, 1992

INVENTOR(S) : Dennis M. Scamardo

It is certified that error appears in the above-identified patent and that said Letters Patent is hereby corrected as shown below:

Page 2, Column 4, Line 20

Delete "gate" and Insert ---grate---

Signed and Sealed this

Tenth Day of August, 1993

Attest:

Michael K. Kirk

MICHAEL K. KIRK

Attesting Officer

Acting Commissioner of Patents and Trademarks